United States Patent [19]

Clark et al.

[11] 4,080,126

[45] Mar. 21, 1978

[54] WATER ATOMIZER FOR LOW OXYGEN METAL POWDERS

[75] Inventors: Ian Sidney Rex Clark, Greenwood Lake, N.Y.; Benjamin Joseph Baltrukovicz, Oak Ridge, N.J.

[73] Assignee: The International Nickel Company, Inc., New York, N.Y.

[21] Appl. No.: 749,113

[22] Filed: Dec. 9, 1976

[51] Int. Cl.[2] ..... B22D 23/08

[52] U.S. Cl. ..... 425/7; 264/12

[58] Field of Search ..... 425/7; 264/12

[56] References Cited

U.S. PATENT DOCUMENTS

| | | | |
|---|---|---|---|
| 2,470,569 | 5/1949 | Meighan et al. | 425/7 |
| 2,956,304 | 10/1960 | Batten et al. | 425/7 |
| 3,281,893 | 11/1966 | Ayers | 425/7 |
| 3,533,136 | 10/1970 | Holtz, Jr. | 425/7 |
| 3,752,611 | 8/1973 | Reed et al. | 425/7 |
| 3,771,929 | 11/1973 | Hellman et al. | 425/7 |
| 3,813,196 | 5/1974 | Backstrom et al. | 425/7 |
| 3,814,558 | 6/1974 | Ayers | 425/7 |
| 4,011,290 | 3/1977 | Blomqvist et al. | 425/7 X |

*Primary Examiner*—Robert L. Spicer, Jr.

*Attorney, Agent, or Firm*—Walter A. Petersen; Ewan C. MacQueen

[57] ABSTRACT

Apparatus and method for water atomizing molten metal to provide a low oxygen metal powder. A molten metal stream is introduced to an atomization vessel containing a pressurized inert gas. The metal stream is atomized, by impingement of high pressure water within the atomization vessel. The atomization vessel has an exit aperture located so that the slurry of water and metal powder can exit from the atomization vessel only after deflection within the atomization vessel. Inert gas contained within the atomization vessel and entrapped within the slurry during atomization begins to leave the slurry during deflection, the inert gas returning to the atomization vessel atmosphere. The inert gas removal process continues after passage through the exit aperture and entrance into a closed degassing vessel. In this vessel, substantially all of the inert gas is removed from the slurry by gravity separation for return to the atmosphere of the atomization vessel, and the turbulent conditions initially present in the slurry are substantially dissipated prior to passage of the slurry from the closed degassing vessel.

3 Claims, 1 Drawing Figure

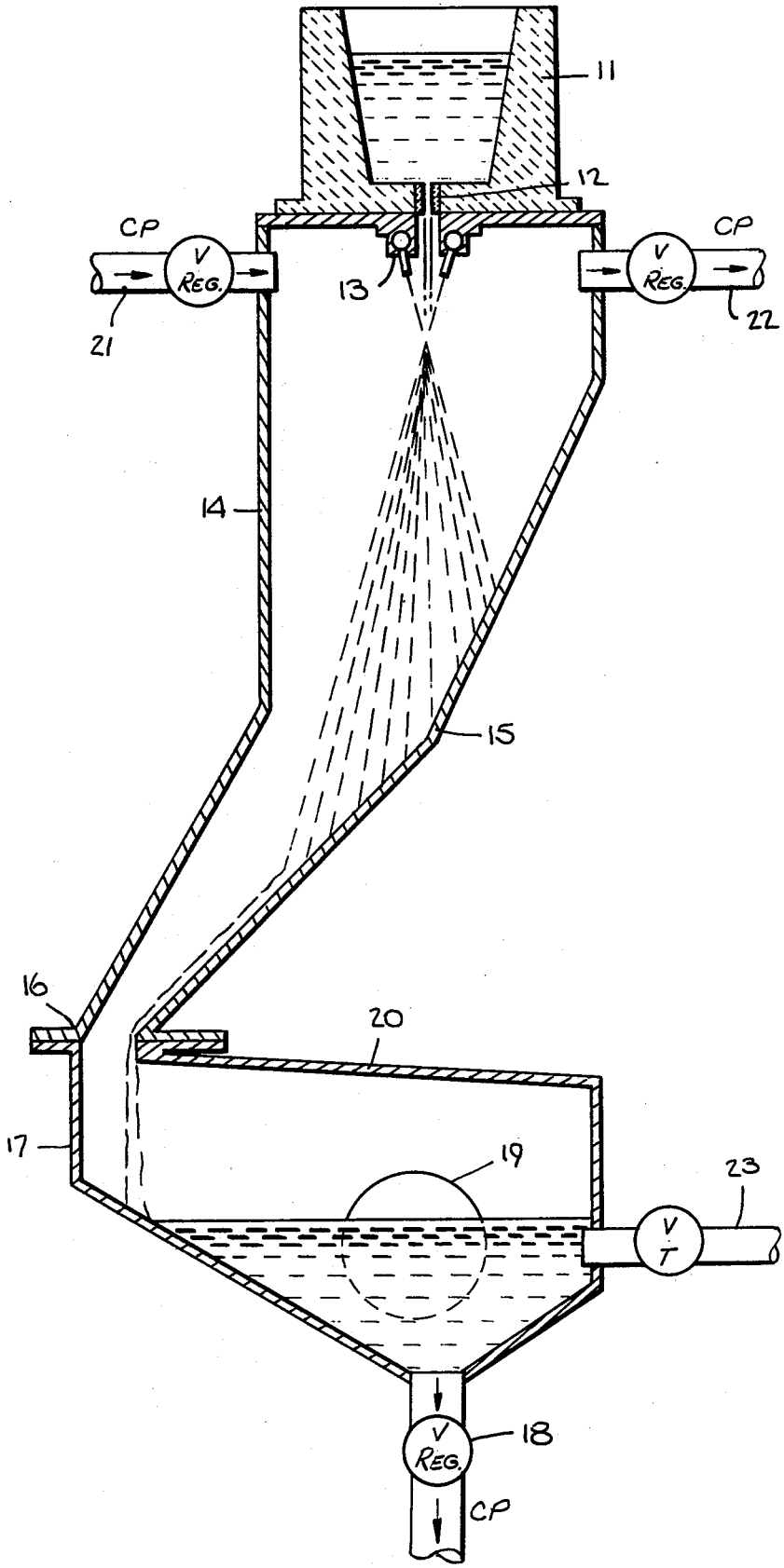
11
12
CP
V
REG.
13
CP
V
REG.
21
22
14
15
16
20
17
19
23
V
T
V
REG.
18
CP

WATER ATOMIZER FOR LOW OXYGEN METAL POWDERS

The present invention relates to an apparatus and method for water atomizing molten metal to provide a low oxygen metal powder.

Powdered metals are being used in increasing quantities for applications where conventionally prepared cast and/or wrought metals were formerly used. In conventional powder metallurgy processes, it is advantageous for metal powder particles to possess an irregular shape so that the particles will interlock during consolidation. Irregularly shaped particles are conveniently obtained by the use of a water atomization process in which a molten metal stream is contacted by high pressure jets of water. However, water atomized powders are generally subject to oxidation during atomization. A low oxygen content in as-atomized metal powder is associated with improved bonding and green strength, shorter sintering time, a cleaner microstructure, and the use of a more economical sintering furnace atmosphere.

Typically, an oxygen content on the order of about 1% is found in water atomized metal powders produced by conventional techniques. Recently oxygen contents less than about 0.25% have been reported as a result of the use of specialized water atomization techniques. However, even these processes do not necessarily provide the desired level of improvement in powdered metal purity as regards oxygen level.

The deficiency of prior art devices is primarily associated with the ingestion of air through leaks in the atomizing chamber. Air leaking into the atomizing chamber due to the presence of a partial vacuum during the atomization process serves to contaminate the inert gas within the chamber and, consequently, the atomized metal. Furthermore, when reactive alloys, e.g., those containing chromium, are water atomized, disassociation of water will result thereby providing substantial quantities of hydrogen and the danger of the explosive combination of such hydrogen with oxygen present from leakage.

It has now been discovered that exceptionally low oxygen contents can be attained in metal powders that are water atomized within an atomization vessel containing a non-oxidizing or inert gas atmosphere and having a closed degassing vessel positioned so that the slurry stream formed during atomization does not impinge directly thereon.

Objects and advantages of this invention will become apparent from the drawing taken in view of the following description in which the drawing depicts a cross sectional view of a preferred embodiment of the atomization apparatus.

Generally speaking, the present invention is an apparatus for water atomization of a molten metal stream comprising an atomization vessel having a nozzle means located in an upper region of said atomization vessel for causing at least one stream of water to impinge on at least one vertically descending stream of molten metal to atomize said molten metal; a means for supplying molten metal and water to said nozzle means; an exit aperture in a lower part of said atomization vessel for permitting a slurry of water and atomized metal to exit from said atomization vessel, said exit aperture being offset with respect to the vertical axis of said nozzle means to a sufficient extent to insure that said slurry can exit only after deflection within said atomization vessel; and a closed degassing vessel positioned below said exit aperture and communicating with said exit aperture.

In a preferred embodiment, an arcuate deflector means is provided to slow the velocity of the downwardly directed slurry stream and to direct the stream toward the exit aperture. These actions improve the efficiency with which entrapped non-oxidizing or inert gas, which is present within the apparatus, is removed from the slurry and returned to the apparatus. Also, and of considerable importance, the arcuate deflector means substantially limits splashback of the slurry to the top of the atomization vessel. Splashback such as that which might occur, for example, in an atomization vessel having a rectangular cross section, can lead to cracking of the nozzle and refractories at the top of the vessel and clogging of the nozzle and jets.

Although it is most desirable to use a deflector member having a continuous parabolic shape with a steep slope at its top and a shallow slope at its bottom, (i.e., a gently curving path), a series of downwardly sloping flat panels has been found to perform satisfactorily. In a preferred embodiment, a side wall of the atomization vessel is used as the deflector means. The wall is prepared from two flat plates intersecting at the vertical axis of the nozzle at an included angle of 160°. The upper plate is inclined from the vertical at an angle of 25°, and the lower plate is inclined from the vertical at an angle of 45°. In addition to the flat wall, parabolic surface, and angled flat plates, other means for deflecting the course of the slurry are contemplated and include the use of cone-shapes, spheres, wedges, cylindrical surfaces, and an enclosed conveyor belt mechanism.

In one preferred embodiment, it is advantageous to use more than one exit aperture. Accordingly, the design of the upper and lower chambers can be shaped to accommodate such a configuration. In this embodiment, a deflector resembling a triangular prism separates the atomization vessel from the closed degassing vessel and provides two exit apertures. The deflector can be used in conjunction with multiple nozzles and jets having vertical axes aligned to the approximate midpoints of the two deflector surfaces. The deflector can have an upper vertical plate member intersecting second flat plate members inclined from the vertical at a 20° angle. The second flat plate members can be bent to meet third flat plate members. The third flat plate members can be incined at a 50° angle to the vertical axis and extend to the exit aperture.

In still another embodiment, the exit aperture is a conduit leading to a closed degassing vessel removed some distance from the atomization vessel. In this regard, however, it is preferred that the closed degassing vessel be located as close as possible to the atomization vessel to provide the smallest possible volume within the atomization apparatus in order to minimize the presence of oxygen.

It is considered advantageous to provide passageways along the edges of the arcuate deflector means to improve the flow of inert gas returning from the quiescent slurry of the closed degassing vessel to the atomization vessel. Such passageways are located within the atomization vessel so that, as for the exit aperture, they are offset with respect to the nozzle means, and any slurry that may pass through these passsageways is deflected prior to entering these passageways.

As already mentioned, the exit aperture is located so that the slurry issuing from the nozzle means is deflected within the atomization vessel prior to passing through the exit aperture and entering the closed degassing vessel. By placing the exit aperture at this location, undesirable turbulence, that would otherwise be provided by the direct action of the slurry issuing from the nozzle means on a pool of slurry, is avoided. In prior art devices, where direct impingement of the slurry stream on a pool of slurry occurs, a substantial amount of the inert gas remains within the slurry pool and is removed from the atomization apparatus. Removal of the inert gas creates a vacuum that serves to draw air into the atomizer thereby increasing the oxygen content of the metal powder.

The closed degassing vessel is preferably located directly below and sealed to the exit aperture so that a positive inert gas pressure is maintained within the atomization apparatus. The degassing vessel should be shaped so that the slurry streams issuing from the exit aperture are allowed to merge together for a sufficient time within the degassing vessel so that substantially all of the entrapped inert gas is released from the slurry before the slurry is removed from the degassing vessel. Generally, the lower walls of the degassing vessel are inclined toward a slurry exit means to approximately direct flow. An included angle of 60° between these walls and the vertical axis of the atomization unit has been found to be useful for this purpose.

During atomization, the slurry contained within the degassing vessel is maintained at a level sufficient to allow time for turbulence to substantially dissipate and for entrapped inert gas bubbles to rise to the surface of the slurry and return to the internal environment of the atomization apparatus. The slurry level within the degassing vessel can be maintained by visual observation through a glass-covered viewport, coupled with opening and closing of the slurry exit means. A manually operated flapper valve has been found to be useful for the purpose of establishing such a pressure head; however, it is to be understood that other mechanical devices or electro-mechanical devices which serve to maintain positive pressure within the degassing vessel and avoid the back-flow of air therein can be substituted for the flapper valve and are considered within the scope of this invention. Generally, the slurry is removed from the closed degassing vessel at a rate proportional to the rate of atomization of the molten metal.

To avoid formation of a gas pocket at the top of the degassing chamber, thereby lowering the efficiency of inert gas bubble removal, it is advantageous to provide a slope to the upper enclosing member of the degassing vessel directed toward the exit aperture. An upward slope of about 5° from horizontal has been found to be effective for this purpose.

Although only one nozzle means is described in the preferred embodiment, it is to be understood that the use of more than one nozzle means within a single atomization vessel, e.g., four nozzle means, is considered to be within the scope of this invention. Such an arrangement with multiple nozzle means is particularly advantageous for a continuous operation.

The function and operation of the apparatus of this invention will be more clearly understood from a description of the drawing which represents a preferred embodiment.

The apparatus has a means for supplying molten metal 11 which can be an alumina, 11% silica lined tundish having a nozzle means 12 (teeming nozzle) adapted to control the flow of molten metal therethrough. During operation, the internal surface of the tundish and nozzle means should be preheated to above about 900° C prior to the introduction of molten metal therein. Molten metal should be superheated to a temperature at least 40° C above the melting point of the metal. The diameter of the teeming nozzle should be between about 5 and 13mm so that metal flow rates of from about 20 to about 100 kg/minute are attained under steady state conditions. The means for supplying molten metal also contains a means for supplying water 13 in the form of high pressure water passageways connected to water jets.

The means for supplying molten metal is sealably disposed to the atomization vessel 14. In the embodiment shown in the drawing, one of the walls of the atomization vessel is shaped to form an arcuate deflector means 15. The arcuate deflector means is positioned to deflect the slurry of metal powder and water issuing from the nozzle means toward the exit aperture 16. The exit aperture is offset from the vertical axis of the nozzle means to a sufficient extent so that slurry cannot enter the exit aperture without first being deflected from the arcuate deflector means.

During operation of the atomization apparatus, it is preferred that a tight cone of slurry be maintained since this provides rapid cooling of the metal powder particles thereby promoting low oxygen content within these powder particles. Such a tight cone can be attained by using 4 to 12 water jets having a fan angle betwen 0 and 15°, (i.e., a cylindrical hole representing 0° versus a tapered hole having walls with 15° included angle, 7–½° to axis of hole). The jets can be disposed at about a 10 to 15° angle with the vertical. Water flow rates should be between about 150 to about 500 liter/minute at pressures between about 1.5 to 15 $N/mm^2$.

Directly beneath the exit aperture is a closed degassing vessel 17. This vessel serves to further reduce the turbulence present in the slurry stream and allow inert gas entrapped within the slurry stream to separate from the slurry and return to the gaseous environment within the atomization apparatus.

The level of the slurry contained within the closed degassing vessel is regulated with the slurry exit means 18. A flapper valve, actuated remotely from a station atop the atomization apparatus, can be used for this purpose. The flow rate through the slurry exit means is regulated to provide a pressure head of slurry above the slurry exit means. Control of the slurry level can be accomplished by regulation of the slurry exit means coupled with visual observation through a viewpoint 19 or by other suitable mechanical or electro-mechanical means. The pressure head prevents the entry of air from the atmosphere into the interior portions of the atomization apparatus. It is beneficial to provide the upper enclosing member 20 with a slight upward slant of about 5° toward the exit aperture to avoid the entrapment of inert gas within the degassing vessel.

An inert gas entrance 21 and an inert gas exhaust 22 are provided near the top of the atomization vessel. Inert gases such as argon, nitrogen, helium, etc., are introduced through the inert gas entrance to provide a substantially oxygen-free atmosphere within the atomization apparatus. Both the entrance valve and exhaust valve (check valve) are generally selected to provide for constant pressure within the apparatus, generally about 1.005 atmosphere (5cm of water).

A throttle valve 23 is provided within the closed degassing vessel located at a suitable distance above the slurry exit means as an aid in the provision of a substantially pure inert gas environment within the atomization apparatus. The throttle valve is used in conjunction with a siphon gage, (i.e., a standing water leg), by an operator at the top of the vessel to observe the level of liquid within the vessel during a water-displacement, air-removal operation. This throttle valve is also used for removing the water at a controlled rate from the bottom of the atomization apparatus while it is being refilled with an inert gas.

In one embodiment, the slurry issuing from the slurry exit means is allowed to fall through the air and is collected in a separate collecting vessel (not shown). In another embodiment, the slurry passes through the slurry exit means into a conduit leading to a separate collecting vessel. The slurry issuing from the conduit enters at the top of the collecting vessel falling through an air space maintained at the top of the collecting vessel. The atomized metal powder gravity separates from the water and settles to the bottom of the collecting vessel. The metal powder is removed from the vessel and is dried by any suitable means, (e.g., a heated, vacuum drier).

For the purpose of giving those skilled in the art a better understanding of the invention, the following illustrative examples are given:

EXAMPLE I

An atomization apparatus conforming to the preferred configuration for the apparatus of this invention, as illustrated in the drawing, was used to prepare a copper, 24.7% nickel alloy. The atomization vessel, exit aperture, and closed degassing chamber were prepared from stainless steel. A wall of the atomization vessel was used as the arcuate deflector means. The deflector was prepared from two flat plates intersecting at the vertical axis of the nozzle at an inclined angle of 160°. The upper plate was inclined from the vertical at an angle of 25°, and the lower plate was inclined from the vertical at an angle of 45°. The lower plate extended downward to the exit aperture.

To provide an essentially oxygen-free environment, the atomization apparatus was filled to within about 5cm of the top with water introduced through the means for supplying water in the form of atomization jets. Nitrogen was introduced through an inert gas entrance valve at the top of the atomization vessel, and the space at the top of the atomizer was purged for about five minutes with the gas exiting through the inert gas exhaust, a single-flow direction valve, located at the top of the atomization vessel. Following the purging operation, the inert gas exhaust valve was closed. The water was forced from the atomization vessel and closed degassing vessel through a valve located about 20cm above the bottom of the closed degassing vessel so that about 20 centimeters of water remained above the closed slurry exit means.

While the atmospheric gases within the atomization apparatus were being replaced with nitrogen, a 135-kilogram heat of a copper, 25% nickel alloy was air melted in an induction furnace having a clay-graphite lining. The heat was deoxidized with a small amount of carbon and heated to a pouring temperature of 1400° C. Chemical analysis of a sample removed from the tundish during the pour showed an oxygen content of 0.0037%.

The heat of molten metal was poured into the alumina, 11% silica lined tundish. The tundish had been preheated to about 1000° C using a gas fired burner operated to provide a reducing atmosphere. The tundish had a 7.5 millimeter diameter teeming nozzle stoppered with a tapered graphite rod. This arrangement served to prevent influx of air to the atomization vessel prior to the introduction of the molten metal.

To initiate the atomization process, molten metal was poured into the tundish. The eight water jets having a jet orifice of 2.26 millimeter and a 0° fan angle, (i.e., having a cylindrical bore), were started within the atomization vessel using a water pressure of 10.3 $N/mm^2$ provided by a 230 liter/minute constant displacement pump. The graphite rod was lifted from the tundish and the molten metal gravity fed through the teeming nozzle to contact the high pressure water jets.

An inert atmosphere was maintained within the apparatus during atomization by the passage of nitrogen through the inert gas entrance valve at a flow rate of 51 liters per minute to provide a positive pressure of about 1.005 atmosphere.

The water level within the closed degassing vessel was controlled manually by visual observation through a viewing port and regulation of the slurry exit means to provide a water level between about 10 and 15cm above this flapper valve. The slurry of water and metal powder was observed to form numerous rivulets at the exit aperture. These flowed with relatively little turbulence into the closed degassing vessel. Entrapped bubbles of nitrogen and the small amount of turbulence were observed to quickly dissipate within the first few inches of travel within the slurry contained within the closed degassing vessel, the nitrogen returning to the interior of the atomization apparatus. The slurry was in a substantially quiescent state prior to passage through the slurry exit means. The 135-kilogram heat was atomized in about 3½ minutes.

Chemical analysis of the dried copper, 24.7% nickel alloy, which had a shiny-grey metallic appearance, showed an oxygen content of 0.018% in the −40 mesh metal powder and an oxygen content of 0.022% in the −325 mesh fraction. A heat of a copper, 25.3% nickel alloy made under essentially identical conditions in a water atomization unit having no degassing vessel showed an oxygen content of 0.260% in −40 mesh powder and 0.290% in the −325 mesh fraction.

EXAMPLE II

The atomization apparatus described in Example I was used to atomize a heat of essentially pure nickel.

The air contained within the atomization unit was displaced using the procedure described in Example I using argon as the purging gas. Forty-five kilograms of electrolytic nickel were melted under an argon blanket in an alumina, 11% silica lined induction furnace. The nickel was deoxidized with small additions of magnesium and calcium and heated to a pouring temperature of 1600° C. Chemical analysis showed an oxygen content of 0.017% in the furnace prior to pouring and 0.20% in the tundish. An argon flow rate of 51 liters per minute was maintained throughout the atomization run. A water pressure of 8.4 $N/mm^2$ was transmitted through eight 2.38mm diameter jets. The 45-kilogram heat was atomized in a time period of about two minutes.

The −40 mesh nickel powder, which had a shiny-grey metallic appearance, contained 0.039% oxygen. The −325 mesh fraction contained 0.042% oxygen. Nickel powder produced under essentially identical conditions in a water atomization unit having no degassing vessel showed an oxygen content of 0.200% in the −40 mesh powder and 0.210% in the −325 mesh fraction.

EXAMPLE III

A 45-kilogram heat of type 316 stainless steel was atomized in the apparatus described in Example I.

The atomization unit was substantially cleared of air using argon as the purging medium. The type 316 stainless steel was melted under an argon blanket in an alumina, 11% silica lined induction furnace. The melt was deoxidized with carbon, silicon, and manganese. Chemical analyses showed an oxygen content of 0.023% in the furnace and 0.035% in the tundish. The molten alloy was heated to 1565° C and atomized using a water pressure of 10.3 N/mm$^2$. A positive pressure of about 1.005 atmosphere was maintained within the appratus during atomization using an argon flow rate of 51 liter/minute.

The −40 mesh powder had a shiny-grey metallic appearance and contained 0.11% oxygen. A substantially identical heat prepared in a water atomization unit having no degassing vessel showed an oxygen content of 0.20% in −40 mesh powder. Chemical analysis showed that the alloy of this example contained 16.6% Cr, 13.6% Ni, 2.55% Mo, 0.89% Si, 0.15% Mn, 0.024% C, 0.14% Cu, 0.004% S, 0.019% P, and the balance essentially Fe.

EXAMPLE IV

A low-expansion alloy containing about 43% nickel, balance iron was prepared in the apparatus and with the procedures described in Example I.

The air contained within the atomization unit was displaced using argon as the purging gas. The 45-kilogram heat was melted under a blanket of argon gas in an alumina, 11% silica lined induction furnace. The heat was deoxidized by the addition of a small amount of carbon. The alloy was heated to 1590° C and poured into a preheated tundish having a 7.14 millimeter diameter teeming nozzle. Chemical analysis showed that the molten alloy contained 0.083% oxygen in the furnace and 0.095% in the tundish. A water pressure of 10.3 N/mm$^2$ and an argon flow rate of 51 liters/minute were maintained during atomization. The alloy was atomized in about two minutes.

Chemical analysis showed that the iron base alloy contained 42.8% nickel. The −40 mesh powder had a shiny-grey metallic appearance and contained 0.160% oxygen. The −325 mesh fraction contained 0.170% oxygen. An alloy having essentially the same composition as the alloy of this example but prepared in a water atomization unit having no degassing vessel showed an oxygen content of 0.310% in −40 mesh powder and 0.310% in the −325 mesh fraction.

EXAMPLE V

A 45-kilogram heat of a 31% nickel, 21% chromium, balance iron alloy was water atomized in the apparatus described in Example I.

Nickel base alloys containing relatively high levels of chromium are not normally prepared by water atomization since the chromium present in the alloy reacts with the water used for atomization to produce large quantities of hydrogen. Such hydrogen can react with atmospheric oxygen that leaks into presently known water atomization units to provide a potential explosive source. Due to the combination of features of the present invention, it is now possible to safely water atomize alloys that would normally produce large quantities of hydrogen when water atomized.

The heat was melted in an alumina, 11% silica lined induction furnace under a blanket of argon gas. The alloy was deoxidized with small quantities of manganese, silicon, and calcium and heated to 1540° C. Chemical analyses showed that the heat contained 0.022% oxygen at the time of pouring into the tundish and after pouring, 0.038% oxygen.

TABLE I

SIZE DISTRIBUTION AND OXYGEN CONTENT OF A 21% Cr, 31% Ni, BAL. Fe WATER ATOMIZED POWDER

| Mesh Size Fraction | Weight Percent | |
|---|---|---|
| | Size Distribution | Oxygen Content |
| +40 | 0.43 | 0.65 |
| −40 + 60 | 1.3 | 0.53 |
| −60 + 80 | 1.4 | 0.51 |
| −80 + 100 | 3.8 | 0.42 |
| −100 + 200 | 28.7 | 0.33 |
| −200 + 325 | 26.5 | 0.33 |
| −325 | 37.8 | 0.16 |

The air within the atomization unit was displaced in the manner described in Example I using argon gas at a flow rate of 51 liters per minute. Due to the generation of large amounts of hydrogen as a result of water disassociation during the atomization process, the argon flow was discontinued during atomization. The gas exiting from the inert gas exhaust was observed to burn where it contacted a propane gas fired safety flame located immediately adjacent to the exhaust. Chemical analysis of the exhaust gas showed that it contained 65% argon, 30.3% hydrogen, 2.4% nitrogen, 0.42% oxygen, 0.11% carbon dioxide, 0.05% carbon monoxide, and 1.6% oxygenated hydrocarbons, (the latter gas resulting from preheating of the tundish with a gas-fired burner).

The −40 mesh powder had a shiny-grey metallic appearance and contained 0.28% oxygen. The oxygen content and size distribution of the various mesh size fractions comprising the metal powder is shown in Table I. The smaller mesh size fractions were found to have the lowest oxygen contents which is believed to result from the more rapid cooling associated with the small particle size. No comparative data is available for the oxygen content of 31% Ni, 21% Cr, bal. Fe alloys prepared by water atomization in an apparatus having no degassing vessel due to the hydrogen associated danger involved in the preparation of chromium-containing alloys.

The angular water-atomized metal powders produced in the apparatus and by the method of this invention are particularly suitable for use with conventional powder metallurgical techniques such as roll compaction and cold pressing followed by sintering treatments. Due to the relatively low oxygen content of the metal powders, they can be used without a post-atomization reducing treatment. Sheet, rod, wire and complex parts can be produced from the angular metal powders.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. An apparatus for water atomization of a molten metal stream characterized by a capability for positive pressurization during operation comprising: an atomization vessel having a nozzle means located in an upper region of said atomization vessel for causing at least one stream of water to impinge on at least one vertically descending stream of molten metal to atomize said molten metal, cool the resulting atomized metal powder and form a slurry of metal powder and water descending turbulently in a vertical direction; means for maintaining an atmosphere of inert gas within said vessel; means for supplying molten metal to said nozzle means; means for supplying water to said nozzle means; an exit aperture in a lower part of said atomization vessel for permitting said slurry to exit from said atomization vessel, said exit aperture being offset with respect to the vertical axis of said nozzle means to a sufficient extent to ensure that said slurry can exit only after deflection within said atomization vessel; and a closed degassing vessel positioned below said exit aperture and communicating with said exit aperture whereby turbulence within said slurry is reduced and an inert gas entrapped within said slurry is gravity separated from said slurry while contained in said degassing vessel and said inert gas in returned to said atomization vessel.

2. An apparatus as defined in claim 1, wherein said atomization vessel contains an arcuate deflector means positioned below said nozzle means and above said exit aperture, said arcuate deflector serving to slow said slurry and to direct said slurry from said vertical direction toward said exit aperture.

3. An apparatus as defined in claim 2, wherein said closed degassing chamber contains a slurry exit means whereby said slurry is removed from said closed degassing chamber at a rate proportional to the rate of atomization of said molten metal.

* * * * *